US012305249B2

(12) United States Patent
Cho et al.

(10) Patent No.: US 12,305,249 B2
(45) **Date of Patent: *May 20, 2025**

(54) HIGH-STRENGTH STRUCTURAL STEEL HAVING EXCELLENT COLD BENDABILITY, AND MANUFACTURING METHOD THEREFOR

(71) Applicant: POSCO, Pohang-si (KR)

(72) Inventors: Jae-Young Cho, Gwangyang-si (KR); Il-Cheol Yi, Gwangyang-si (KR); Sang-Deok Kang, Gwangyang-si (KR)

(73) Assignee: POSCO CO., LTD, Pohang-si (KR)

( * ) Notice: Subject to any disclaimer, the term of this patent is extended or adjusted under 35 U.S.C. 154(b) by 877 days.

This patent is subject to a terminal disclaimer.

(21) Appl. No.: 17/415,394

(22) PCT Filed: Dec. 6, 2019

(86) PCT No.: PCT/KR2019/017148

§ 371 (c)(1),
(2) Date: Jun. 17, 2021

(87) PCT Pub. No.: WO2020/130436

PCT Pub. Date: Jun. 25, 2020

(65) Prior Publication Data

US 2022/0064745 A1 Mar. 3, 2022

(30) Foreign Application Priority Data

Dec. 19, 2018 (KR) ..... 10-2018-0165284

(51) Int. Cl.

| | |
|---|---|
| ***C22C 38/02*** | (2006.01) |
| ***C21D 1/19*** | (2006.01) |
| ***C21D 6/00*** | (2006.01) |
| ***C21D 8/02*** | (2006.01) |
| ***C22C 38/00*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |
| ***C22C 38/58*** | (2006.01) |
| *C21D 1/20* | (2006.01) |
| *C21D 1/22* | (2006.01) |
| *C22C 38/08* | (2006.01) |
| *C22C 38/12* | (2006.01) |
| *C22C 38/14* | (2006.01) |
| *C22C 38/16* | (2006.01) |
| *C22C 38/18* | (2006.01) |

(52) U.S. Cl.

CPC ..... *C21D 8/0263* (2013.01); *C21D 1/19* (2013.01); *C21D 6/005* (2013.01); *C21D 6/008* (2013.01); *C21D 8/02* (2013.01); *C21D 8/0205* (2013.01); *C21D 8/0226* (2013.01); *C22C 38/001* (2013.01); *C22C 38/002* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C22C 38/58* (2013.01); *C21D 1/20* (2013.01); *C21D 1/22* (2013.01); *C21D 2211/001* (2013.01); *C21D 2211/002* (2013.01); *C21D 2211/005* (2013.01); *C22C 38/08* (2013.01); *C22C 38/12* (2013.01); *C22C 38/14* (2013.01); *C22C 38/16* (2013.01); *C22C 38/18* (2013.01)

(58) Field of Classification Search

CPC ..... C22C 38/04

See application file for complete search history.

(56) References Cited

U.S. PATENT DOCUMENTS

| | | | | |
|---|---|---|---|---|
| 5,421,920 | A | 6/1995 | Yamamoto et al. | |
| 2009/0092515 | A1 | 4/2009 | Nakashima et al. | |
| 2015/0144231 | A1 | 5/2015 | Masuda et al. | |
| 2016/0017466 | A1* | 1/2016 | Shibata | C21D 6/002 148/333 |
| 2021/0071279 | A1 | 3/2021 | Cho et al. | |
| 2022/0042146 | A1* | 2/2022 | Yi | C21D 8/0226 |

FOREIGN PATENT DOCUMENTS

| | | | |
|---|---|---|---|
| JP | 2002-020835 | A | 1/2002 |
| JP | 2010-126808 | A | 6/2010 |
| JP | 2013-104124 | A | 5/2013 |
| JP | 2013-249502 | A | 12/2013 |
| JP | 2015-078398 | A | 4/2015 |

(Continued)

OTHER PUBLICATIONS

International Search Report issued in corresponding International Application No. PCT/KR2019/017148 dated Jul. 17, 2020, with English translation.

(Continued)

*Primary Examiner* — Jophy S. Koshy

(74) *Attorney, Agent, or Firm* — Morgan Lewis & Bockius LLP

(57) ABSTRACT

A high-strength structural steel having excellent cold bendability, according to one embodiment of the present invention, comprises, by wt %, 0.02-0.1% of C, 0.01-0.6% of Si, 1.7-2.5% of Mn, 0.005-0.5% of Al, 0.02% or less of P, 0.01% or less of S, 0.0015-0.015% of N, and the balance of Fe and other inevitable impurities, wherein an outer surface layer part and an inner central part thereof are microstructurally divided in a thickness direction, the surface layer part can comprise tempered austenite as a matrix structure, and the central part can comprise bainitic ferrite as a matrix structure.

9 Claims, 7 Drawing Sheets

(56) References Cited

FOREIGN PATENT DOCUMENTS

| | | | |
|---|---|---|---|
| JP | 2015-175039 | A | 10/2015 |
| JP | 2018-095904 | A | 6/2018 |
| KR | 10-1996-0009174 | B1 | 7/1996 |
| KR | 10-2008-0027903 | A | 3/2008 |
| KR | 10-0833076 | B1 | 5/2008 |
| KR | 10-2013-0114239 | A | 10/2013 |
| KR | 10-2015-0122779 | A | 11/2015 |
| KR | 10-1819356 | B1 | 1/2018 |
| KR | 10-2019-0077183 | A | 7/2019 |
| WO | 2014/162680 | A1 | 10/2014 |

OTHER PUBLICATIONS

Japanese Office Action dated Aug. 23, 2022 issued in Japanese Patent Application No. 2021-535061.
Chinese Office Action dated Apr. 26, 2022 issued in Chinese Patent Application No. 201980084388.9 (with English translation).

* cited by examiner

【Fig. 1】
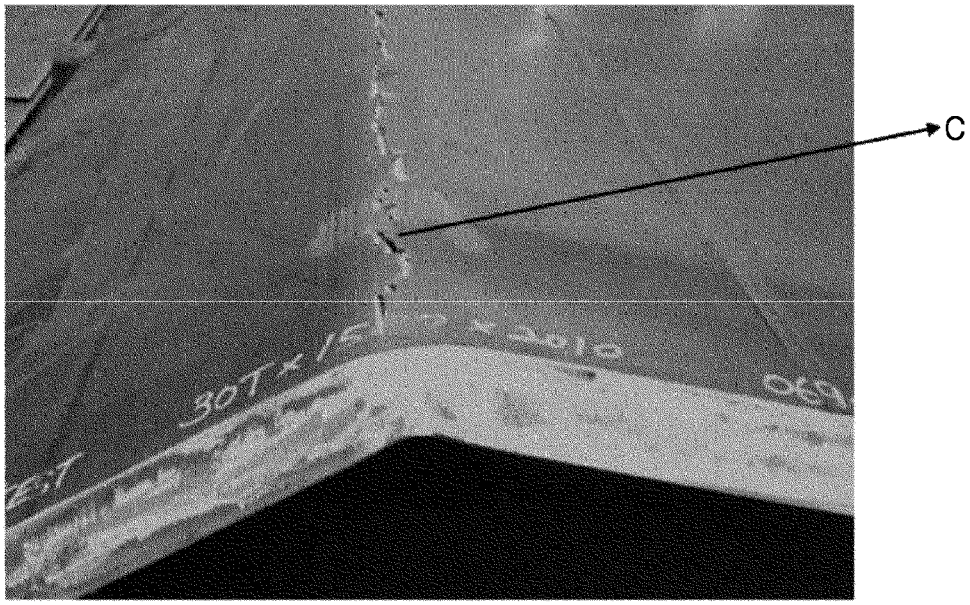

【Fig. 2】
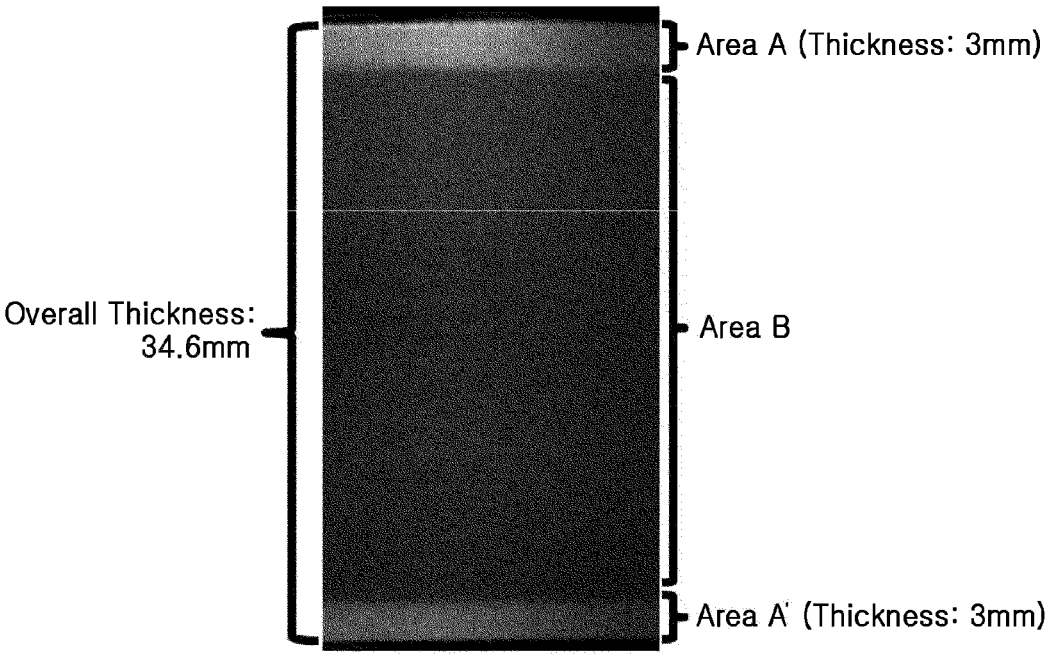

【Fig. 3】
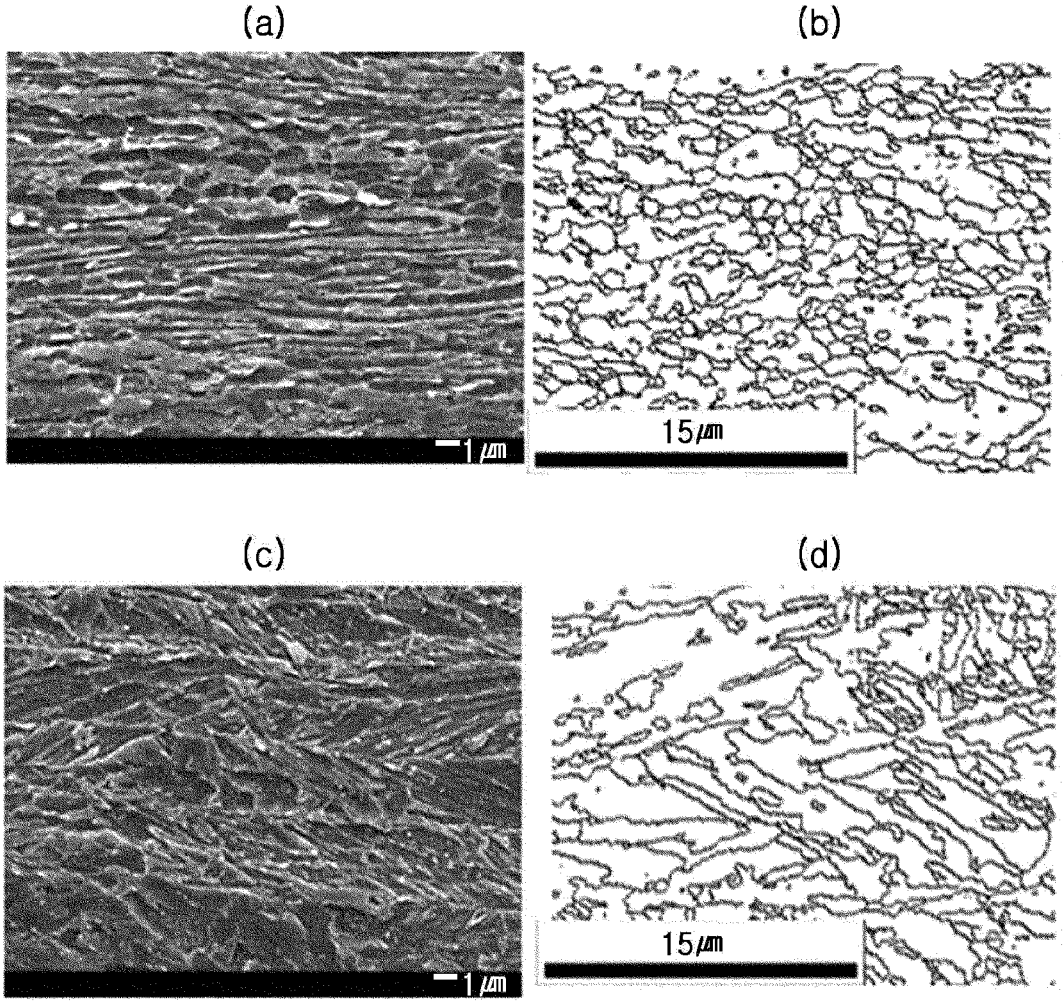

【Fig. 4】
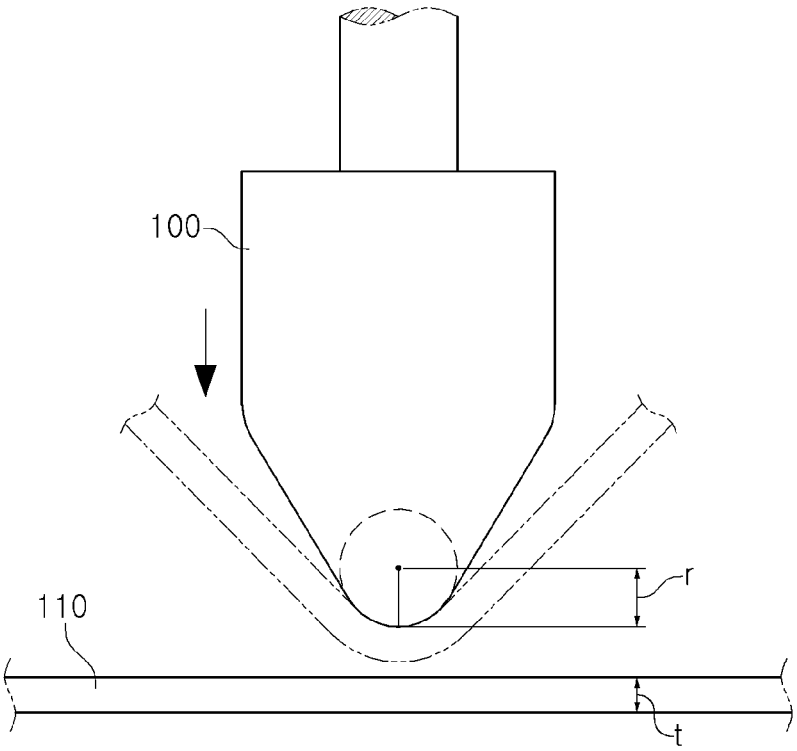

【Fig. 5】
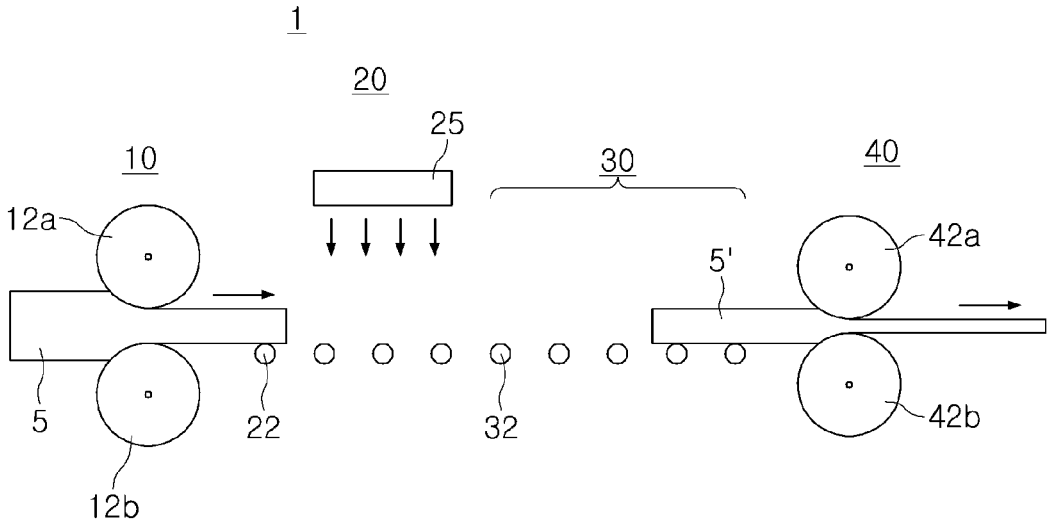
【Fig. 6】
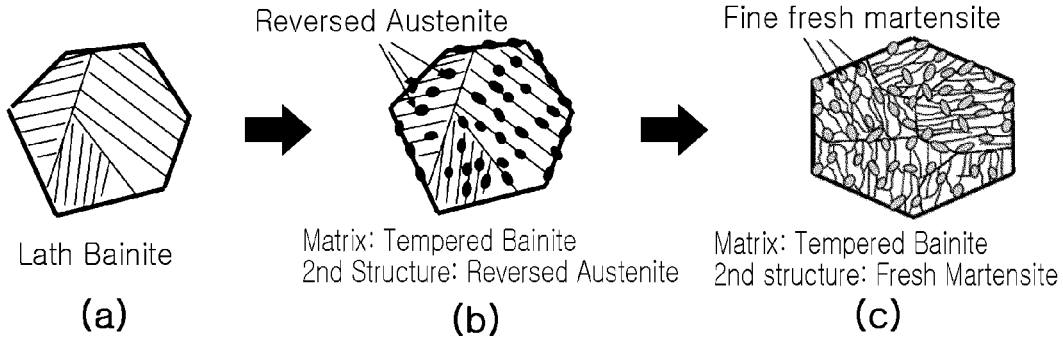

【Fig. 7】
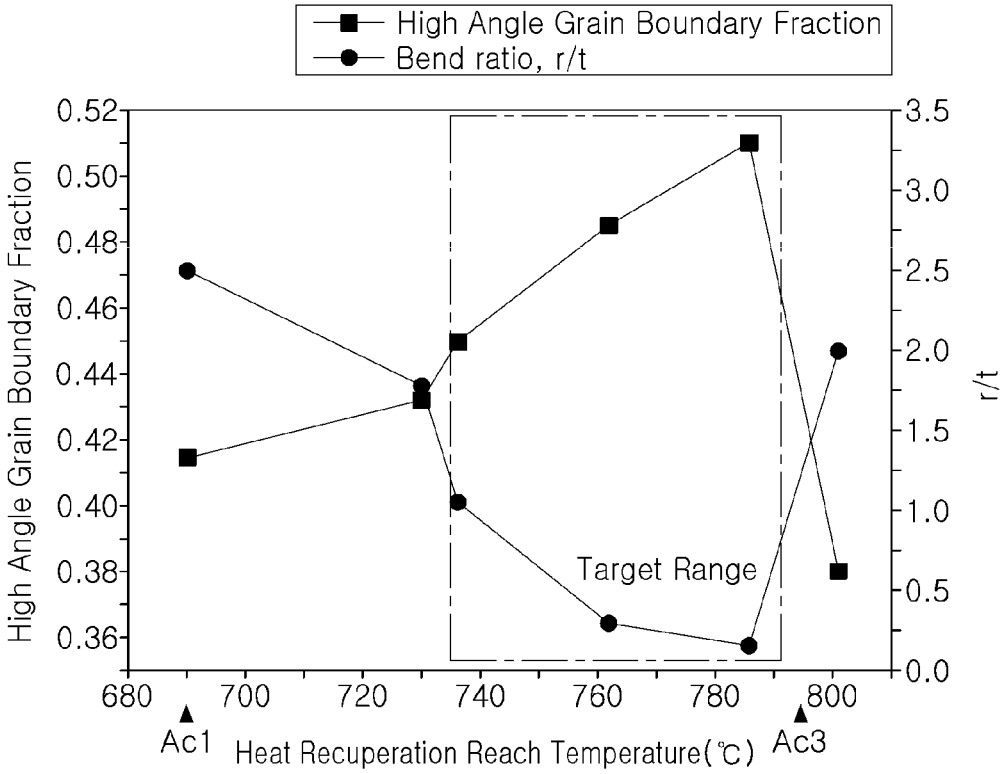

【Fig. 8】
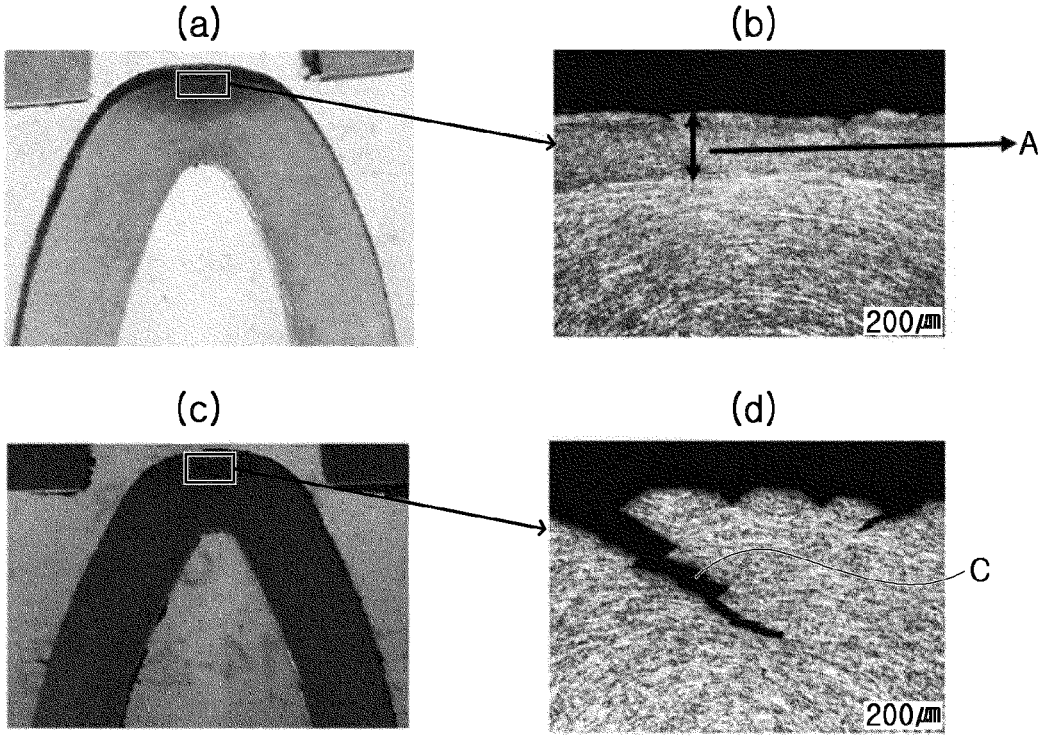

HIGH-STRENGTH STRUCTURAL STEEL HAVING EXCELLENT COLD BENDABILITY, AND MANUFACTURING METHOD THEREFOR

CROSS REFERENCE

This application is the U.S. National Phase under 35 U.S.C. § 371 of International Application No. PCT/KR2019/017148 filed on 6 Dec. 2019, which claims the benefit of Korean Application No. 10-2018-0165284 filed on 19 Dec. 2018, the entire contents of each are hereby incorporated by reference.

TECHNICAL FIELD

The present disclosure relates to a high-strength structural steel and a method of manufacturing the same, and more particularly, to a high-strength structural steel particularly suitable for cold bending processing by optimizing a steel composition, microstructure and manufacturing process, and a method of manufacturing the same.

BACKGROUND ART

In line with the recent trend of increasing the size of building structures, steel pipes for transportation, bridges, or the like, there has been increasing demand for the development of high-strength structural steels having a tensile strength of 800 MPa or more. In the related art, steels are produced by applying a heat treatment method such as quenching-tempering to satisfy such high-strength characteristics, but recently, for reasons of reducing production costs, securing weldability and the like, steel produced by cooling after rolling has replaced existing heat-treated steel.

In the case of steel produced by cooling after rolling, impact toughness is improved due to the finer structure, but due to excessive cooling, since a structure having inferior elongation, such as bainite or martensite, is formed in the thickness direction from the surface layer of the steel sheet, the elongation rate of the entire steel is significantly lowered. Such a decrease in the elongation of the steel acts as a technical limitation in the processing of the steel. In detail, in the case of cold bending a steel produced by cooling after rolling, as illustrated in FIG. 1, relatively greatest plasticity occurs on the surface of the processed part of the steel, and cracks (C) occur in the surface of processed part of the steel, in the thickness direction from the surface of the steel. Accordingly, there is an urgent need to develop structural steel which has high strength characteristics and which may actively suppress the occurrence of cracks in the surface of processed part even by a process such as cold bending or the like.

Patent Document 1 proposes a technique for fine-graining the surface layer of a steel material, but the surface layer is mainly made of equiaxial ferrite grains and elongated ferrite grains, and there is a problem that the technique cannot be applied to high-strength steels having a tensile strength of 800 MPa or higher. In addition, in Patent Document 1, the rolling process should be essentially performed in the middle of the heat recuperative treatment of the surface layer, in order to refine the surface layer, which leads to difficulty in controlling the rolling process.

PRIOR TECHNICAL LITERATURE (Patent Document 1) Japanese Patent Laid-Open Publication No. 2002-020835 (published on Jan. 23, 2002)

DISCLOSURE

Technical Problem

According to an aspect of the present disclosure, a high-strength structural steel having excellent cold bendability and a method of manufacturing the same may be provided.

The subject of the present disclosure is not limited to the above description. Those skilled in the art will have no difficulty in understanding the additional subject of the present disclosure from the general contents of the present specification.

Technical Solution

According to an aspect of the present disclosure, a high-strength structural steel having excellent cold bendability, comprises, by weight %, 0.02-0.1% of C, 0.01-0.6% of Si, 1.7-2.5% of Mn, 0.005-0.5% of Al, 0.02% or less of 2, 0.01% or less of S, 0.0015-0.015% of N, a balance of Fe, and other unavoidable impurities, wherein the high-strength structural steel are microstructurally divided into an outer surface layer part and an inner central part in a thickness direction, wherein the surface layer part comprises tempered bainite as a matrix structure, and the central part comprises bainitic ferrite as a matrix structure.

The surface layer part may include an upper surface layer portion on an upper side of the steel, and a lower surface-layer portion on a lower side of the steel, and the upper surface layer portion and the lower surface layer portion may each have a thickness of 3 to 10% of a thickness of the steel.

The surface layer part may further include fresh martensite as a second structure, and the tempered bainite and the fresh martensite may be included in the surface layer part in a fraction of 95 area % or more.

The surface layer part may further include austenite as a residual structure, and the austenite may be included in the surface layer part in a fraction of 5 area % or less.

The bainitic ferrite may be included in the central part in a fraction of 95 area % or more.

An average grain size of a microstructure of the surface layer part may be 3 μm or less (excluding 0 μm).

An average grain size of a microstructure of the central part may be 5 to 20 μm.

The high-strength structural steel having excellent cold bendability may further include, by weight %, one or two or more of Ni: 0.01-2.0%, Cu: 0.01-1.0%, Cr: 0.05-1.0%, Mo: 0.01-1.0%, Ti: 0.005-0.1%, Nb: 0.005-0.1%, V: 0.005-0.3%, B: 0.0005-0.004%, and Ca: 0.006% or less.

A tensile strength of the steel may be 800 MPa or more, and a high angle grain boundary fraction of the surface layer part may be 45% or more.

In a cold bending test, in which a plurality of cold bending jigs having various tip curvature radii (r) are applied to cold-bending the steel by 180° and then whether cracks occur in the surface layer part of the steel occur is observed, and the cold bending jig is applied such that the tip curvature radii (r) are sequentially decreased, a critical curvature ratio (r/t) may be 1.0 or less, the critical curvature ratio (r/t) being a ratio of the tip curvature radii (r) of the cold bending jig at a time when the cracks occur in the surface layer part of the steel, with respect to a thickness (t) of the steel.

According to an aspect of the present disclosure, a method of manufacturing a high-strength structural steel having excellent cold bendability includes reheating a slab at a temperature ranging of 1050 to 1250° C., the slab including, by weight %, 0.02-0.1% of C, 0.01-0.6% of Si, 1.7-2.5% of Mn, 0.005-0.5% of Al, 0.02% or less of P, 0.01% or less of S, 0.0015-0.015% of N, a balance of Fe, and other unavoidable impurities, rough rolling the slab in a temperature range of Tnr to 1150° C. to provide a rough-rolled bar, first cooling the rough-rolled bar to a temperature ranging from Ms to Bs ° C. at a cooling rate of 5° C./s or more, maintaining a surface layer part of the first cooled rough-rolled bar to be reheated to a temperature ranging from (Ac1+40° C.) to (Ac3-5° C.) by heat recupreation, finish rolling the rough-rolled bar subjected to a heat recuperative treatment, and second cooling the finish rolled steel to a temperature of Bf ° C. or less at a cooling rate of 5° C./s or more.

The slab may further include, by weight %, one or two or more of Ni: 0.01 to 2.0%, Cu: 0.01 to 1.0%, Cr: 0.05 to 1.0%, Mo: 0.01 to 1.0%, Ti: 0.005 to 0.1%, Nb: 0.005 to 0.1%, V: 0.005 to 0.3%, B: 0.0005 to 0.004%, and Ca: 0.006% or less.

The rough-rolled bar may be first cooled by water cooling immediately after the rough-rolling.

The first cooling may be initiated at a temperature of Ae3+100° C. or less, based on a temperature of the surface layer part of the rough-rolled bar.

The rough-rolled bar may be finishing rolled in a temperature range of Bs to Tnr° C.

The means for solving the above problems are not all of the features of the present disclosure, and various features of the present disclosure and advantages and effects thereof will be understood in more detail with reference to the specific embodiments below.

Advantageous Effects

According to an exemplary embodiment, there may be provided a structural steel having excellent cold bendability while having a high strength characteristic of 800 MPa or more of tensile strength, and a method of manufacturing the same.

DESCRIPTION OF DRAWINGS

FIG. 1 is an image of a related art material in which cracks are generated in the surface of the processed part by cold bending.

FIG. 2 is an image of a cross section of a steel specimen according to an exemplary embodiment of the present disclosure.

FIGS. 3A to 3D are images of observing the microstructures of an upper surface layer portion (A) and a central part (B) of the specimen of FIG. 2.

FIG. 4 is a diagram schematically illustrating an example of a cold bending test.

FIG. 5 is a diagram schematically illustrating an example of equipment for implementing a manufacturing method according to an exemplary embodiment of the present disclosure.

FIGS. 6A to 6C provide conceptual diagrams schematically illustrating a change in the microstructure of the surface layer part by the heat recuperative treatment according to an exemplary embodiment of the present disclosure.

FIG. 7 is a graph provided by experimentally measuring the relationship between the temperature attaining the heat recuperative treatment, the high angle grain boundary fraction and the critical bending ratio (r/t) of the surface layer part.

FIGS. 8A to 8D are cross-sectional observation images of specimen B-1 and specimen B-4 after performing cooling bending thereon under the conditions of a bending ratio (r/t) of 0.3.

BEST MODE FOR INVENTION

The present disclosure relates to a high-strength structural steel having excellent cold bendability and a method of manufacturing the same, and hereinafter, exemplary embodiments of the present disclosure will be described. Embodiments of the present disclosure may be modified in various forms, and the scope of the present disclosure should not be construed as being limited to the embodiments described below. The embodiments are provided in order to further detail the present disclosure to those of ordinary skill in the art to which the present disclosure pertains.

Hereinafter, a steel composition according to an exemplary embodiment of the present disclosure will be described in more detail. Hereinafter, unless otherwise indicated, % and ppm indicating the content of each element are based on weight.

A high-strength structural steel having excellent cold bendability according to an exemplary embodiment of the present disclosure may include, by weight %, 0.02-0.1% of C, 0.01-0.6% of Si, 1.7-2.5% of Mn, 0.005-0.5% of Al, 0.02% or less of P, 0.01% or less of S, 0.0015-0.015% of N, a balance of Fe, and other unavoidable impurities. In addition, the high-strength structural steel having excellent cold bendability according to an exemplary embodiment of the present disclosure may further include, by weight %, one or two or more of Ni: 0.01-2.0%, Cu: 0.01-1.0%, Cr: 0.05-1.0%, Mo: 0.01-1.0%, Ti: 0.005-0.1%, Nb: 0.005-0.1%, V: 0.005-0.3%, B: 0.0005-0.004%, and Ca: 0.006% or less.

Carbon (C): 0.02-0.10%

Carbon (C) is an important element for securing hardenability in the present disclosure. In addition, carbon (C) is also an element that significantly affects the formation of the bainitic ferrite structure in the present invention. Accordingly, carbon (C) needs to be included in the steel within an appropriate range to obtain this effect, and in the present disclosure, the lower limit of the carbon (C) content may be limited to 0.02%. However, if the content of carbon (C) exceeds a predetermined range, the low-temperature toughness of the steel material decreases, and thus, in the present disclosure, the upper limit of the content of carbon (C) may be limited to 0.10%. Accordingly, the carbon (C) content in the present disclosure may be 0.02 to 0.10%. In addition, in the case of a steel material provided for a welding structure, it may be more preferable to limit the range of the carbon (C) content to be 0.03 to 0.08% in terms of securing weldability.

Silicon (Si): 0.01-0.6%

Silicon (Si) is an element used as a deoxidizer, and is an element that contributes to improving strength and improving toughness. Accordingly, in an exemplary embodiment of the present disclosure, the lower limit of the silicon (Si) content may be limited to 0.01% to obtain such an effect. A preferable lower limit of the silicon (Si) content may be 0.05%, and a more preferable lower limit of the silicon (Si) content may be 0.1%. However, if the content of silicon (Si) is added excessively, low-temperature toughness and weldability may be deteriorated, and thus, in the present disclosure, the upper limit of the content of silicon (Si) may be limited to 0.6%. The preferable upper limit of the silicon (Si) content may be 0.5%, and more preferably, the upper limit of the silicon (Si) content may be 0.45%.

Manganese (Mn): 1.7-2.5%

Manganese (Mn) is an element useful for improving strength by solid solution strengthening, and is also an element that may economically increase hardenability. Therefore, in an exemplary embodiment of the present disclosure, the lower limit of the manganese (Mn) content may be limited to 1.7% to obtain such an effect. A preferable lower limit of the manganese (Mn) content may be 1.72%, and a more preferable lower limit of the manganese (Mn) content may be 1.75%. However, if manganese (Mn) is added excessively, the toughness of the weld may be greatly reduced due to an excessive increase in hardenability. Thus, in the present disclosure, the upper limit of the manganese (Mn) content may be limited to 2.5%. The preferable upper limit of the manganese (Mn) content may be 2.4%, and more preferably, the upper limit of the manganese (Mn) content may be 2.35%.

Aluminum (Al): 0.005-0.5%

Aluminum (Al) is a representative deoxidizing agent that may economically deoxidize molten steel, and is an element that contributes to improving the strength of a steel material. Therefore, in an exemplary embodiment of the present disclosure, the lower limit of the aluminum (Al) content may be limited to 0.005% to obtain this effect. The lower limit of the aluminum (Al) content may preferably be 0.01%, and more preferably, the lower limit of the aluminum (Al) content may be limited to 0.015%. However, if aluminum (Al) is added excessively, it may cause clogging of the continuous casting nozzle during continuous casting, and thus, in an exemplary embodiment of the present disclosure, the upper limit of the aluminum (Al) content may be limited to 0.5%. Preferably, the upper limit of the aluminum (Al) content may be 0.3%, and more preferably, the upper limit of the aluminum (Al) content may be 0.1%.

Phosphorus (P): 0.02% or Less

Phosphorus (P) is an element that contributes to improving strength and improving corrosion resistance, but it may be preferable to keep the content thereof as low as possible because phosphorus may greatly impair impact toughness. Accordingly, the phosphorus (P) content in an exemplary embodiment of the present disclosure may be 0.02% or less, and more preferably, phosphorus (P) content may be 0.15% or less.

Sulfur (S): 0.01% or Less

Sulfur (S) is an element that greatly inhibits impact toughness by forming non-metallic inclusions such as MnS or the like, and thus, it may be preferable to keep the content as low as possible. Therefore, in the present disclosure, the upper limit of the sulfur (S) content may be limited to 0.01%, and the upper limit of the sulfur (S) content may more preferably be 0.005%. However, sulfur (S) is an impurity that is unavoidably introduced in the steelmaking process, and controlling the amount thereof to be a level of less than 0.001% is not desirable from an economic standpoint.

Nitrogen (N): 0.0015-0.015%

Nitrogen (N) is an element that contributes to improving the strength of steel material. However, if the addition amount is excessive, the toughness of the steel material is greatly reduced, and thus, in an exemplary embodiment of the present disclosure, the upper limit of the nitrogen (N) content may be limited to 0.015%. The upper limit of the nitrogen (N) content may preferably be 0.012%. However, nitrogen (N) is an impurity that is unavoidably introduced in the steelmaking process, and controlling the nitrogen (N) content to be a level of less than 0.0015% is not desirable from an economic standpoint.

Nickel (Ni): 0.01-2.0%

Nickel (Ni) is almost the only element capable of simultaneously improving the strength and toughness of the base material, and in an exemplary embodiment of the present disclosure, the lower limit of the nickel (Ni) content may be limited to 0.01% to obtain this effect. A preferable lower limit of the nickel (Ni) content may be 0.03%, and a more preferable lower limit of the nickel (Ni) content may be 0.05%. However, nickel (Ni) is an expensive element, and excessive addition is not preferable in terms of economic efficiency, and weldability may deteriorate if the amount of nickel (Ni) is excessive. Therefore, in an exemplary embodiment of the present disclosure, the upper limit of the nickel (Ni) content may be limited to 2.0%. The upper limit of the nickel (Ni) content may preferably be 1.5%, and the upper limit of the nickel (Ni) content may more preferably be 1.2%.

Copper (Cu): 0.01-1.0%

Copper (Cu) is an element that contributes to strength improvement while significantly reducing the decrease in toughness of the base material. Therefore, in an exemplary embodiment of the present disclosure, the lower limit of the copper (Cu) content may be limited to 0.01% to obtain this effect. A preferable lower limit of the copper (Cu) content may be 0.02%, and a more preferable lower limit of the copper (Cu) content may be 0.03%. However, if the amount of copper (Cu) is excessive, the quality of the final product surface may be impaired. In the present disclosure, the upper limit of the copper (Cu) content may be limited to 1.0%. The upper limit of the copper (Cu) content may preferably be 0.8%, and the upper limit of the copper (Cu) content may more preferably be 0.6%.

Chrome (Cr): 0.05-1.0%

Since chromium (Cr) is an element that effectively contributes to an increase in strength by increasing hardenability, in an exemplary embodiment of the present disclosure, the lower limit of the chromium (Cr) content may be limited to 0.05% to obtain this effect. The lower limit of the chromium (Cr) content may preferably be 0.06%. However, if the content of chromium (Cr) is excessive, weldability may be greatly deteriorated, and thus, in an exemplary embodiment of the present disclosure, the upper limit of the content of chromium (Cr) may be limited to 1.0%. The upper limit of the chromium (Cr) content may preferably be 0.8%, and the upper limit of the chromium (Cr) content may more preferably be 0.6%.

Molybdenum (Mo): 0.01-1.0%

Molybdenum (Mo) is an element that greatly improves the hardenability with only a small amount of addition, and molybdenum suppresses the generation of ferrite, thereby greatly improving the strength of the steel material. Therefore, in an exemplary embodiment of the present disclosure, the lower limit of the molybdenum (Mo) content may be limited to 0.01% to obtain this effect. A preferable lower limit of the molybdenum (Mo) content may be 0.012%, and a more preferable lower limit of the molybdenum (Mo) content may be 0.014%. However, if the content of molybdenum (Mo) is excessive, the hardness of the weld may be excessively increased, and thus, in an exemplary embodiment of the present disclosure, the upper limit of the content of molybdenum (Mo) may be limited to 1.0%. The upper limit of the molybdenum (Mo) content may preferably be 0.7%, and the upper limit of the molybdenum (Mo) content may more preferably be 0.5%.

Titanium (Ti): 0.005-0.1%

Titanium (Ti) is an element that greatly improves low-temperature toughness by suppressing the growth of crystal grains during reheating. Accordingly, in an exemplary embodiment of the present disclosure, the lower limit of the titanium (Ti) content may be limited to 0.005% to obtain this effect. A preferable lower limit of the titanium (Ti) content may be 0.007%, and a more preferable lower limit of the titanium (Ti) content may be 0.009%. However, if the content of titanium (Ti) is added excessively, problems such as clogging of the continuous casting nozzle or reduction of low-temperature toughness due to crystallization in the central part may occur. Therefore, in an exemplary embodiment of the present disclosure, the upper limit of the titanium (Ti) content may be limited to 0.1%. A preferable upper limit of the titanium (Ti) content may be 0.08%, and a more preferable upper limit of the titanium (Ti) content may be 0.06%.

Niobium (Nb): 0.005-0.1%

Niobium (Nb) is one of important elements in the manufacture of TMCP steel, and is also an element that greatly contributes to the improvement of the strength of the base material and the weld by depositing in the form of carbide or nitride. In addition, niobium (Nb) dissolved during reheating of the slab suppresses recrystallization of austenite, and suppresses the transformation of ferrite and bainite to refine the structure, and the lower limit of the niobium (Nb) content in an exemplary embodiment of the present disclosure may be 0.005%. A preferable lower limit of the niobium (Nb) content may be 0.01%, and a more preferable lower limit of the niobium (Nb) content may be 0.015%. However, if the content of niobium (Nb) is excessive, coarse precipitates are generated to generate brittle cracks in the corners of the steel material, and thus, the upper limit of the niobium (Nb) content may be limited to 0.1%. The upper limit of the niobium (Nb) content may preferably be 0.08%, and the upper limit of the niobium (Nb) content may more preferably be 0.06%.

Vanadium (V): 0.005-0.3%

Vanadium (V) has a lower solid solution temperature than other alloy compositions, and is an element capable of preventing a decrease in strength of the weld by being precipitated in the weld heat-affected zone. Accordingly, in an exemplary embodiment of the present disclosure, the lower limit of the vanadium (V) content may be limited to 0.005% to obtain this effect. A preferable lower limit of the vanadium (V) content may be 0.008%, and a more preferable lower limit of the vanadium (V) content may be 0.01%. However, if vanadium (V) is added excessively, there is a concern that the toughness of the steel material is deteriorated, and thus, in an exemplary embodiment of the present disclosure, the upper limit of the vanadium (V) content may be limited to 0.3%. A preferable upper limit of the vanadium (V) content may be 0.28%, and a more preferable upper limit of the vanadium (V) content may be 0.25%.

Boron (B): 0.0005-0.004%

Boron (B) is an inexpensive addition element, but it is a beneficial element that may effectively increase hardenability even with a small amount of addition. Further, in the present disclosure, since boron (B) is an element that greatly contributes to the formation of bainite even under low-speed cooling conditions in cooling after rough rolling, in an exemplary embodiment of the present disclosure, the lower limit of the boron (B) content may be limited to 0.0005%. A preferable lower limit of the boron (B) content may be 0.0008%, and a more preferable lower limit of the boron (B) content may be 0.001%. However, if boron (B) is added excessively, $Fe_{23}(CB)_6$ is formed, which rather lowers the hardenability, and significantly lowers the low-temperature toughness, and thus, in an exemplary embodiment of the present disclosure, the upper limit of the boron (B) content may be limited to 0.004%. The upper limit of the boron (B) content may preferably be 0.0035%, and the upper limit of the boron (B) content may more preferably be 0.003%.

Calcium (Ca): 0.006% or Less

Calcium (Ca) is mainly used as an element that controls the shape of non-metallic inclusions such as MnS or the like and improves low-temperature toughness. However, excessive addition of calcium (Ca) causes formation of a large amount of CaO—CaS and formation of coarse inclusions due to bonding, and thus, problems such as a decrease in the cleanliness of the steel and a decrease in field weldability may occur. Accordingly, in an exemplary embodiment of the present disclosure, the upper limit of the calcium (Ca) content may be limited to 0.006%, and more preferably, the upper limit of the calcium (Ca) content may be 0.004%.

In an exemplary embodiment of the present disclosure, in addition to the above-described steel composition, the remainder may contain Fe and unavoidable impurities. Unavoidable impurities may be unintentionally incorporated in a general steel manufacturing process and the mixing thereof cannot be completely excluded, and those skilled in the ordinary steel manufacturing field may easily understand the meaning. In addition, the present disclosure does not entirely exclude addition of a composition other than the aforementioned steel composition.

The high-strength structural steel having excellent cold bendability according to an exemplary embodiment of the present disclosure is not particularly limited in thickness, but may preferably be a structural thick steel having a thickness of 10 mm or more, and may more preferably be a structural thick steel having a thickness of 20 to 100 mm.

Hereinafter, the microstructure according to an exemplary embodiment of the present disclosure will be described in more detail.

A high-strength structural steel having excellent cold bendability according to an exemplary embodiment of the present disclosure may be divided into surface layer parts on the surfaces of the steel material and a central part positioned between the surface layer parts, which is micro-structured in the thickness direction of the steel material. The surface layer part may be divided into an upper surface layer portion in the upper side of the steel material and a lower surface layer portion in the lower side of the steel material. The upper surface layer portion and the lower surface layer portion may each have a thickness of a level of 3 to 10% of a thickness t of the steel material.

The surface layer part may include tempered bainite as a matrix structure, and fresh martensite and austenite as a second structure and a balance structure, respectively. A fraction occupied by tempered bainite and fresh martensite within the surface layer part may be 95 area % or more, and a fraction occupied by an austenite structure within the surface layer part may be 5 area % or less. The fraction occupied by the austenite structure in the surface layer part may also be 0 area %.

The central part may include bainitic ferrite as a matrix structure, and a fraction occupied by the bainitic ferrite in the central part may be 95 area % or more. In terms of securing the required strength, a more preferable fraction of bainitic ferrite may be 98 area % or more.

A microstructure of the surface layer part may have an average grain size of 3 μm or less (excluding 0 μm), and a microstructure of the central part may have an average grain size of 5 to 20 μm. In this case, the average grain size of the microstructure of the surface layer part may indicate the case in which the average grain size of each of tempered bainite, fresh martensite, and austenite is 3 μm or less (excluding 0 μm), and the average grain size of the microstructure of the central part may indicate the case in which the average grain size of bainitic ferrite is 5 to 20 μm. In more detail, the average grain size of the microstructure of the central part may be 10 to 20 μm.

FIG. 2 is an image of a cross section of a steel specimen according to an embodiment of the present disclosure. As illustrated in FIG. 2, the steel specimen according to an embodiment of the present disclosure is divided into upper and lower surface layer portions (A, A') on the upper and lower surface sides thereof, and a central part (B) between the upper and lower surface layer portions (A, A'), and it can be seen that the boundary between the upper and lower surface layer portions (A, A') and the central part (B) is clearly formed enough to be seen with the naked eye. For example, it can be seen that the upper and lower surface layer portions (A, A') and the central part (B) of the steel material according to an exemplary embodiment of the present disclosure are clearly distinguished micro-structurally.

FIGS. 3A to 3D are images of an observation of the microstructure of the upper surface layer portion (A) and the central part (B) of the specimen of FIG. 2. FIGS. 3A and 3B are images of the upper surface layer portion (A) of the specimen observed with a scanning electron microscope (SEM), and a high angle grain boundary map imaged using EBSD for the upper surface layer portion (A) of the specimen. FIGS. 3C and 3D are images of the central part (B) of the specimen observed with a scanning electron microscope (SEM), and a high angle grain boundary map imaged using EBSD for the upper surface layer portion (A) of the specimen. As illustrated in FIGS. 3A to 3D, it can be seen that the upper surface layer portion (A) contains tempered bainite and fresh martensite having an average grain size of about 3 μm or less, whereas the central part (B) contains bainitic ferrite having an average grain size of about 15 μm.

The high-strength structural steel having excellent cold bendability according to an exemplary embodiment of the present disclosure has a surface layer part and a central part distinguished micro-structurally, and in this case, the central part contains bainitic ferrite as a matrix structure, and thus, high-strength characteristics may be effectively secured with a tensile strength of 800 MPa or more.

In addition, the high-strength structural steel having excellent cold bendability according to an exemplary embodiment of the present disclosure includes a surface layer part and a central part divided into microstructure, and in this case, the relatively fine-grained surface layer part includes tempered bainite as a matrix structure, and fresh martensite as a second structure, and may secure a high angle grain boundary fraction of 45% or more, thereby securing excellent cold bendability.

The evaluation of the cold bendability may be obtained through the following cold bending test. FIG. 4 is a diagram schematically illustrating an example of a cold bending test. As illustrated in FIG. 4, the tip of a cold bending jig 100 is provided so as to be compressed to the surface of a steel material 110 to cold-bend the steel material 110 by 180°, and the cold bendability of the steel material 110 may be evaluated, based on whether or not cracks occur on the surface of the cold bending processed-portion side of the steel material 110. For example, by using the cold bending jigs 100 having various tip curvature radii (r), 180° cold bending may be performed on a plurality of specimens manufactured with the same composition and manufacturing method, and in this case, the cold bending may be performed in a manner of sequential decrease in the curvature radii (r) of the tip portions. Therefore, the cold bendability may be evaluated based on whether cracks occur on the surfaces of the processed-portion sides of the specimens. At this time, at a point in time of occurrence of cracking, the critical curvature ratio (r/t), which is the ratio of the tip curvature radius (r) of the cold bending jig with respect to the thickness (t) of the specimen, is calculated. It can be interpreted that the lower the calculated critical curvature ratio (r/t) is, the more actively the occurrence of surface cracks of the steel material is suppressed even under severe cold bending conditions. Therefore, the high-strength structural steel having excellent cold bendability according to an exemplary embodiment of the present disclosure has a critical curvature ratio (r/t) of 1.0 or less, thereby securing excellent cold bendability. A preferable critical curvature ratio (r/t) may be 0.5 or less, and a more preferable critical curvature ratio (r/t) may be 0.4 or less.

Hereinafter, the method of manufacturing a high-strength structural steel according to an exemplary embodiment will be described in more detail.

Reheating of Slab

Since the slab provided in the manufacturing method of the present disclosure is provided with a steel composition corresponding to the steel composition of the steel material described above, the description of the steel composition of the slab is replaced by the description of the steel composition of the steel material described above.

The slab manufactured with the above-described steel composition may be reheated at a temperature ranging of 1050 to 1250° C. To sufficiently solid-dissolve carbonitrides of Ti and Nb formed during casting, the lower limit of the reheating temperature of the slab may be limited to 1050° C. However, if the reheating temperature is excessively high, there is a concern that austenite may become coarse, and it takes an excessive time for the surface layer temperature of the rough-rolled bar to reach the first cooling start temperature after rough rolling, and thus, the upper limit of the reheating temperature may be limited to 1250° C.

Rough Rolling

Rough rolling may be performed after reheating to adjust the shape of the slab and destroy the cast structure such as dendrite. To control the microstructure, rough rolling may preferably be performed at the temperature (Tnr, ° C.) or higher, at which recrystallization of austenite stops, and the upper limit of the rough rolling temperature may be preferably limited to 1150° C. in consideration of the cooling start temperature of the first cooling. Therefore, the rough rolling temperature in the present disclosure may be in the range of Tnr-1150° C. In addition, the rough rolling in the present disclosure may be carried out under conditions of a cumulative reduction ratio of 20 to 70%.

First Cooling

After the rough rolling is finished, first cooling may be performed to form lath bainite on the surface layer part of the rough-rolled bar. The preferable cooling rate of the first cooling may be 5° C./s or more, and the preferable cooling attainment temperature of the first cooling may be in a temperature range of Ms to Bs ° C. If the cooling rate of the first cooling is less than a certain level, a polygonal ferrite or granular bainite structure rather than a lath bainite structure is formed on the surface layer part. In the present disclosure, therefore, the cooling rate of the first cooling may be limited to 5° C./s or more. In addition, the cooling method of the first cooling is not particularly limited, but water cooling may be more preferable in terms of cooling efficiency. On the other hand, if the cooling start temperature of the first cooling is too high, there is a possibility that the lath bainite structure formed on the surface layer part by the first cooling may become coarse. Therefore, the starting temperature of the first cooling may be limited to Ae3+100° C. or less.

To significantly increase the effect of the heat recuperative treatment, the first cooling in the present disclosure may be preferably carried out immediately after rough rolling. FIG. 5 is a diagram schematically illustrating an example of a facility 1 for implementing the manufacturing method in the present disclosure. Along the movement path of a slab 5, a roughing mill 10, a cooling device 20, a recuperative treatment table 30 and a finishing mill 40 are sequentially disposed, and the roughing mill 10 and the finishing mill 40 are provided with rough rolling rollers 12*a* and 12*b* and finish rolling rollers 42*a* and 42*b*, respectively, to perform rolling of the slab 5 and a rough rolled bar 5'. The cooling device 20 may include a bar cooler 25 capable of spraying cooling water and an auxiliary roller 22 guiding the movement of the rough rolled bar 5'. It may be more preferable in terms of significantly increasing the reheat treatment effect that the bar cooler 25 is disposed immediately after the roughing mill 10. The recuperative treatment table 30 is disposed at the rear of the cooling device 20, and the rough-rolled bar 5' may be recuperative-treated while moving along an auxiliary roller 32. The rough-rolled bar 5' after the heat recuperative treatment may be moved to the finishing mill 40 to be finished rolled. In the above, a facility for manufacturing a high-strength structural steel having excellent cold bendability according to an exemplary embodiment of the present disclosure is described based on FIG. 5, but the facility 1 as described above is only an example of a facility for carrying out the present disclosure. Therefore, the steel in the present disclosure is not necessarily to be construed as being manufactured by the facility 1 illustrated in FIG. 5.

Heat Recuperative Treatment

After the first cooling, a heat recuperative treatment in which the surface layer side of the rough-rolled bar is reheated by high heat at the central part side of the rough-rolled bar may be performed. The heat recuperative treatment may be performed until the temperature of the surface layer part of the rough-rolled bar reaches a temperature range of (Ac1.40° C.) to (Ac3-5° C.). By the heat recuperative treatment, the lath bainite in the surface layer part may be transformed into a fine tempered bainite and fresh martensite structure, and a portion of the lath bainite in the surface layer part may be reversely transformed into austenite.

FIG. 6 is a conceptual diagram schematically illustrating a change in the microstructure of the surface layer part by the heat recuperative treatment in the present disclosure.

As illustrated in FIG. 6A, the microstructure of the surface layer part immediately after the first cooling may be formed of a lath bainite structure. As illustrated in FIG. 6B, as the heat recuperative treatment proceeds, the lath bainite in the surface layer part is transformed into a tempered bainite structure, and a portion of the lath bainite in the surface layer part may be reversely transformed into austenite. By performing finishing rolling and second cooling after the heat recuperative treatment, as illustrated in FIG. 6C, a two-phase mixed structure of tempered bainite and fresh martensite may be formed, and some austenite structure may remain.

FIG. 7 is a graph provided by experimentally measuring the relationship between the temperature attaining the heat recuperative treatment, the high angle grain boundary fraction of the surface layer part and the critical bending ratio (r/t). In the test of FIG. 7, a specimen was manufactured under conditions that satisfy the alloy composition and manufacturing method of the present disclosure, but the experiment was performed by varying the temperature at which the reheat treatment was attained during the reheat treatment. In this case, the high angle grain boundary fraction was evaluated by measuring the fraction of the high angle grain boundary having an azimuth difference of 15 degrees or more by using EBSD, and the critical bending ratio (r/t) was evaluated according to the method described above. As illustrated in FIG. 7, if the attainment temperature on the surface layer part is less than (Ac1+40° C.), it can be seen that a high angle grain boundary of 15 degrees or more is not sufficiently formed and the critical bending ratio (r/t) exceeds 1.0. In addition, if the attainment temperature on the surface layer part exceeds (Ac3-5° C.), it can be confirmed that a high angle grain boundary of 15 degrees or more is not sufficiently formed and thus the critical bending ratio (r/t) exceeds 1.0. Accordingly, in the present disclosure, the attainment temperature on the surface layer part during heat recuperative treatment may be preferably limited to a temperature range of (Ac1+40° C.) to (Ac3-5° C.), such that the surface layer structure is refined, and a high angle grain boundary fraction of 15° or more is 45% or more, and the critical bending ratio (r/t) is 1.0 or less.

Finish Rolling

Finish rolling is performed to introduce a non-uniform microstructure into the austenite structure of the rough-rolled bar. The finishing rolling may be performed in a temperature range of the bainite transformation start temperature (Bs) or more and the austenite recrystallization temperature (Tnr) or less.

Second Cooling

After finishing rolling, second cooling may be performed to form bainitic ferrite in the central part of the steel material. The preferable cooling rate of the second cooling may be 5° C./s or higher, and the preferable cooling reaching temperature of the second cooling may be Bf° C. or lower. The cooling method of the second cooling is also not particularly limited, but water cooling may be preferable in terms of cooling efficiency. If the cooling attainment temperature of the second cooling exceeds a predetermined range or the cooling rate does not reach a certain level, granular ferrite is formed in the central part of the steel material, thereby causing a decrease in strength. Therefore, the cooling attainment temperature of the second cooling in the present disclosure may be limited to Bf° C. or lower, and the cooling rate may be limited to 5° C./s or higher.

DESCRIPTION OF REFERENCE NUMERALS

1: steel manufacturing facility
10: roughing mill
12*a,b*: rough rolling roller
20: cooling device
22: auxiliary roller
25: bar cooler
30: recuperative treatment table
32: auxiliary roller
40: finishing mill
42*a,b*: finish rolling roller
100: cold bending jig
110: steel material

MODE FOR INVENTION

Hereinafter, exemplary embodiments of the present disclosure will be described in more detail through specific examples.

Example

A slab having the steel composition of Table 1 was prepared, and the transformation temperature was calculated based on the steel composition of Table 1 and illustrated in Table 2. In Table 1 below, the contents of boron (B), nitrogen (N) and calcium (Ca) are based on ppm.

TABLE 1

| Steel | Alloy Composition (wt %) | | | | | | | | | | | | | | | |
|---|---|---|---|---|---|---|---|---|---|---|---|---|---|---|---|---|
| Grade | C | Si | Mn | P | S | Al | Ni | Cu | Cr | Mo | Ti | Nb | V | B* | N* | Ca* |
| A | 0.07 | 0.15 | 2 | 0.009 | 0.004 | 0.028 | 0.4 | 0.1 | 0.15 | 0.1 | 0.015 | 0.02 | 0.10 | 13 | 42 | 10 |
| B | 0.054 | 0.18 | 1.75 | 0.001 | 0.004 | 0.027 | 0.1 | 0.03 | 0.06 | 0.03 | 0.013 | 0.03 | 0.05 | 12 | 26 | 14 |
| C | 0.045 | 0.3 | 2.15 | 0.012 | 0.002 | 0.023 | 0.3 | 0.16 | 0.1 | 0.015 | 0.015 | 0.04 | 0.15 | 20 | 47 | 3 |
| D | 0.089 | 0.45 | 2.35 | 0.013 | 0.003 | 0.035 | 0.4 | 0.15 | 0.46 | 0.2 | 0.019 | 0.04 | 0.05 | 19 | 40 | 4 |
| E | 0.065 | 0.25 | 2.2 | 0.013 | 0.002 | 0.03 | 0.3 | 0.26 | 0.05 | 0.05 | 0.018 | 0.03 | 0.20 | 15 | 42 | 28 |
| F | 0.012 | 0.21 | 1.5 | 0.014 | 0.002 | 0.035 | 0 | 0 | 0 | 0 | 0.012 | 0.03 | 0.01 | 8 | 39 | 31 |
| G | 0.13 | 0.32 | 0.8 | 0.013 | 0.001 | 0.04 | 0 | 0.02 | 0 | 0 | 0.016 | 0.03 | 0.01 | 3 | 45 | 5 |
| H | 0.08 | 0.42 | 1.3 | 0.011 | 0.003 | 0.024 | 0.2 | 0.05 | 0.15 | 0.05 | 0.012 | 0.04 | 0.02 | 2 | 35 | 12 |
| I | 0.079 | 0.25 | 1.1 | 0.016 | 0.004 | 0.03 | 0 | 0 | 0 | 0.07 | 0.01 | 0.04 | 0.03 | 1 | 50 | 9 |

TABLE 2

| Steel | Temperature (° C. ) | | | | | |
|---|---|---|---|---|---|---|
| Grade | Bs | Bf | Tnr | Ms | Ac3 | Ac1 |
| A | 598 | 448 | 941 | 439 | 791 | 702 |
| B | 648 | 498 | 914 | 460 | 808 | 709 |
| C | 604 | 454 | 972 | 447 | 808 | 705 |
| D | 530 | 380 | 911 | 415 | 781 | 711 |
| E | 596 | 446 | 989 | 438 | 799 | 703 |
| F | 692 | 542 | 932 | 488 | 824 | 713 |
| G | 723 | 573 | 914 | 460 | 796 | 724 |
| H | 669 | 519 | 905 | 460 | 814 | 720 |
| I | 704 | 554 | 988 | 472 | 806 | 719 |

The slabs having the composition of Table 1 were subjected to rough rolling, first cooling and heat recuperative treatment under the conditions of Table 3 below, and finishing rolling and second cooling were performed under the conditions of Table 4. The evaluation results for the steels manufactured under the conditions of Tables 3 and 4 are illustrated in Table 5 below.

For each steel, the average grain size of the surface layer part, the high angle grain boundary fraction of the surface layer part, the mechanical properties, and the critical bending ratio (r/t) were measured. Thereamong, the grain size and the high angle grain boundary fraction are measured by Electron Back Scattering Diffraction (EBSD) method, measuring a 500 m*500 m area with a 0.5 m step size, and based thereon, a grain boundary map with a crystal orientation difference of 15 degrees or more with neighboring particles was created, and based thereon, the average grain size and high angle grain boundary fraction were evaluated. Yield strength (YS) and tensile strength (TS) were evaluated by obtaining an average value by performing a tensile test on three test pieces in the width direction of the plate, and the critical bending ratio (r/t) was evaluated through the above-described cold bending test.

TABLE 3

| | | Reheating and Rough Rolling | | | | | Heat Recuperative Treatment | |
|---|---|---|---|---|---|---|---|---|
| Steel Grade | Classification | Thickness of Slab Before Rough Rolling (mm) | Rough Rolling Load (%) | Reheating Extraction Temperature (° C.) | Rough Rolling End Temperature (° C.) | 1st Cooling Cooling End Temperature (° C.) | Surface Temperature Reached by Heat Recuperative Treatment (° C.) | Remark |
| A | A-1 | 264 | 38 | 1075 | 995 | 540 | 772 | Recommended Conditions |
| | A-2 | 290 | 67 | 1070 | 975 | 516 | 769 | Recommended Conditions |
| | A-3 | 290 | 58 | 1095 | 990 | 456 | 767 | Recommended Conditions |
| | A-4 | 264 | 50 | 1105 | 1065 | 642 | 850 | Excess of Heat Recuperative Treatment Temperature |
| | A-5 | 255 | 65 | 1120 | 945 | 416 | 696 | Insufficient Heat Recuperative Treatment Temperature |
| | A-6 | 230 | 46 | 1045 | 1015 | 526 | 754 | Recommended Conditions |
| B | B-1 | 295 | 33 | 1065 | 965 | 550 | 771 | Recommended Conditions |
| | B-2 | 290 | 63 | 1075 | 950 | 545 | 756 | Recommended Conditions |
| | B-3 | 230 | 58 | 1100 | 1030 | 541 | 769 | Recommended Conditions |
| | B-4 | 254 | 60 | 1095 | 1075 | 650 | 852 | Excess of Heat Recuperative Treatment Temperature |
| | B-5 | 230 | 42 | 1070 | 985 | 430 | 705 | Insufficient Heat Recuperative Treatment Temperature |
| C | C-1 | 264 | 29 | 1080 | 995 | 550 | 774 | Recommended Conditions |
| | C-2 | 280 | 68 | 1060 | 985 | 525 | 772 | Recommended Conditions |
| | C-3 | 265 | 46 | 1105 | 1080 | 658 | 866 | Excess of Heat Recuperative Treatment Temperature |
| | C-4 | 255 | 65 | 1055 | 975 | 415 | 718 | Insufficient Heat Recuperative Treatment Temperature |
| | C-5 | 260 | 67 | 1080 | 1025 | 475 | 775 | Recommended Conditions |
| D | D-1 | 285 | 54 | 1075 | 975 | 510 | 764 | Recommended Conditions |
| | D-2 | 265 | 63 | 1065 | 985 | 475 | 754 | Recommended Conditions |
| | D-3 | 240 | 58 | 1095 | 1035 | 615 | 802 | Excess of Heat Recuperative Treatment Temperature |
| | D-4 | 260 | 68 | 1015 | 945 | 405 | 698 | Insufficient Heat Recuperative Treatment Temperature |

TABLE 3-continued

| Steel Grade | Classification | Reheating and Rough Rolling: Thickness of Slab Before Rough Rolling (mm) | Rough Rolling Load (%) | Reheating Extraction Temperature (° C.) | Rough Rolling End Temperature (° C.) | 1st Cooling Cooling End Temperature (° C.) | Heat Recuperative Treatment: Surface Temperature Reached by Heat Recuperative Treatment (° C.) | Remark |
|---|---|---|---|---|---|---|---|---|
| E | E-1 | 265 | 46 | 1080 | 990 | 558 | 766 | Recommended Conditions |
| | E-2 | 290 | 67 | 1070 | 995 | 510 | 775 | Recommended Conditions |
| | E-3 | 280 | 58 | 1105 | 993 | 520 | 771 | Recommended Conditions |
| F | F-1 | 255 | 42 | 1085 | 995 | 556 | 769 | Recommended Conditions |
| G | G-1 | 265 | 54 | 1085 | 985 | 563 | 771 | Recommended Conditions |
| H | H-1 | 290 | 58 | 1075 | 945 | 565 | 761 | Recommended Conditions |
| I | I-1 | 295 | 46 | 1075 | 990 | 495 | 775 | Recommended Conditions |

TABLE 4

| Steel Grade | Classification | Finish Rolling: Rolling Start Temperature (° C.) | Rolling End Temperature (° C.) | 2nd Cooling: Cooling Rate (° C./scc) | Cooling End Temperature (° C.) | Remark |
|---|---|---|---|---|---|---|
| A | A-1 | 885 | 845 | 8 | 430 | Recommended Conditions |
| | A-2 | 890 | 850 | 20 | 390 | Recommended Conditions |
| | A-3 | 862 | 822 | 13 | 410 | Recommended Conditions |
| | A-4 | 930 | 890 | 10 | 385 | Recommended Conditions |
| | A-5 | 835 | 795 | 23 | 405 | Recommended Conditions |
| | A-6 | 905 | 865 | 9 | 575 | Cooling end temperature high temperature |
| B | B-1 | 895 | 855 | 9 | 460 | Recommended Conditions |
| | B-2 | 890 | 850 | 17 | 447 | Recommended Conditions |
| | B-3 | 880 | 840 | 15 | 485 | Recommended Conditions |
| | B-4 | 910 | 870 | 23 | 170 | Recommended Conditions |
| | B-5 | 865 | 825 | 11 | 520 | Cooling end temperature high temperature |
| C | C-1 | 900 | 860 | 8 | 415 | Recommended Conditions |
| | C-2 | 880 | 840 | 26 | 430 | Recommended Conditions |
| | C-3 | 950 | 910 | 13 | 450 | Recommended Conditions |
| | C-4 | 870 | 830 | 28 | 400 | Recommended Conditions |
| | C-5 | 800 | 760 | 19 | 620 | Cooling end temperature high temperature |
| D | D-1 | 885 | 845 | 16 | 370 | Recommended Conditions |
| | D-2 | 890 | 850 | 29 | 365 | Recommended Conditions |
| | D-3 | 895 | 855 | 19 | 355 | Recommended Conditions |
| | D-4 | 860 | 820 | 16 | 375 | Recommended Conditions |
| E | E-1 | 902 | 862 | 13 | 435 | Recommended Conditions |
| | E-2 | 910 | 870 | 31 | 415 | Recommended Conditions |
| | E-3 | 920 | 880 | 3 | 405 | Insufficient Cooling Rate |
| F | F-1 | 900 | 860 | 9 | 500 | Recommended Conditions |
| G | G-1 | 880 | 840 | 14 | 490 | Recommended Conditions |
| H | H-1 | 900 | 865 | 15 | 485 | Recommended Conditions |
| I | I-1 | 890 | 850 | 11 | 505 | Recommended Conditions |

TABLE 5

| Steel Grade | Classification | Product Thickness (mm) | Surface Layer Part: Thickness of Surface Layer Part (mm) | Average Grain Size (μm) | Physical Properties: YS (Mpa) | TS (Mpa) | High Angle Grain Boundary Fraction (%) | Critical Curvature Ratio (r/t) | Remark |
|---|---|---|---|---|---|---|---|---|---|
| A | A-1 | 75 | 3 | 1.8 | 724 | 854 | 0.49 | 0.36 | Inventive |
| | A-2 | 25 | 1 | 1.9 | 718 | 850 | 0.48 | 0.38 | Example |
| | A-3 | 50 | 2 | 1.9 | 720 | 845 | 0.47 | 0.39 | |
| | A-4 | 60 | 0 | 9.9 | 795 | 893 | 0.3 | 3 | Comparative |
| | A-5 | 30 | 0 | 5.4 | 755 | 853 | 0.43 | 2.2 | example |
| | A-6 | 65 | 2 | 2.4 | 630 | 750 | 0.46 | 0.39 | |

TABLE 5-continued

| Steel Grade | Classification | Product Thickness (mm) | Surface Layer Part: Thickness of Surface Layer Part (mm) | Surface Layer Part: Average Grain Size (μm) | Physical Properties: YS (Mpa) | Physical Properties: TS (Mpa) | Physical Properties: High Angle Grain Boundary Fraction (%) | Physical Properties: Critical Curvature Ratio (r/t) | Remark |
|---|---|---|---|---|---|---|---|---|---|
| B | B-1 | 80 | 3 | 2.1 | 721 | 856 | 0.48 | 0.29 | Inventive |
| | B-2 | 35 | 1 | 2.7 | 716 | 85 | 0.46 | 0.38 | Example |
| | B-3 | 50 | 2 | 2.2 | 715 | 847 | 0.49 | 0.35 | |
| | B-4 | 30 | 0 | 9.7 | 799 | 869 | 0.28 | 3.5 | Comparative |
| | B-5 | 70 | 0 | 5.1 | 640 | 780 | 0.41 | 2.3 | example |
| C | C-1 | 85 | 3 | 1.9 | 739 | 858 | 0.5 | 0.2 | Inventive |
| | C-2 | 25 | 1 | 2 | 738 | 853 | 0.51 | 0.18 | Example |
| | C-3 | 65 | 0 | 11.9 | 741 | 847 | 0.27 | 4 | Comparative |
| | C-4 | 25 | 0 | 4.7 | 799 | 869 | 0.41 | 2.1 | example |
| | C-5 | 40 | 2 | 1.9 | 625 | 740 | 0.51 | 0.25 | |
| D | D-1 | 55 | 2 | 2.2 | 771 | 877 | 0.46 | 0.37 | Inventive |
| | D-2 | 25 | 1 | 2.6 | 838 | 915 | 0.45 | 0.39 | Example |
| | D-3 | 50 | 0 | 10.1 | 802 | 882 | 0.38 | 1.8 | Comparative |
| | D-4 | 35 | 0 | 5.6 | 778 | 873 | 0.41 | 2.7 | example |
| E | E-1 | 65 | 2 | 2.2 | 765 | 866 | 0.48 | 0.36 | Inventive |
| | E-2 | 20 | 1 | 1.9 | 853 | 921 | 0.52 | 0.24 | Example |
| | E-3 | 50 | 2 | 2 | 655 | 760 | 0.47 | 0.35 | Comparative |
| F | F-1 | 70 | 2 | 2.5 | 495 | 650 | 0.46 | 0.39 | example |
| G | G-1 | 55 | 1 | 2.7 | 395 | 540 | 0.47 | 0.4 | |
| H | H-1 | 50 | 1 | 2.3 | 470 | 655 | 0.48 | 0.37 | |
| I | I-1 | 65 | 2 | 2.8 | 465 | 635 | 0.51 | 0.21 | |

Steel grades A, B, C, D and E are steels that satisfy the alloy composition of the present disclosure. Thereamong, in A-1, A-2, A-3, B-1, B-2, B-3, C-1, C-2, D-1, D-2, E-1 and E-2 which satisfy the process conditions of the present disclosure, it can be confirmed that the high angle grain boundary fraction of the surface layer part satisfies 45% or more, the average grain size of the surface layer part satisfies 3 μm or less, the tensile strength satisfies 800 MPa or more, and the critical bending ratio (r/t) satisfies 1.0 or less.

In the case of A-4, B-4, C-3 and D-3 in which the alloy composition of the present disclosure is satisfied, but the heat recuperative treatment temperature exceeds the scope of the present disclosure, it can be seen that the high angle grain boundary fraction of the surface layer part is less than 45%, the average grain size of the surface layer part exceeds 3 μm, and the critical bending ratio (r/t) exceeds 1.0. This is because the surface layer part of the steel is heated to a temperature higher than that of the two-phase region, such that the structure of the surface layer part is overall, reversely transformed to austenite, and thus the final structure of the surface layer part is formed of lath bainite.

FIGS. 8A and 8B are cross-sectional images and enlarged optical images of the surface layer part after cooling bending under the conditions of a bending ratio (r/t) of 0.3 on B-1, and FIGS. 8C and 8D are cross-sectional images and enlarged optical images of the surface layer part after cooling bending under the conditions of a bending ratio (r/t) of 0.3 on B-4. As illustrated in FIG. 8A to FIG. 8D, in the case of B-1 that satisfies the alloy composition and process conditions of the present disclosure, cracks did not occur on the surface of the processed portion, whereas in the case of B-3 that does not satisfy the process conditions of the present disclosure, it can be confirmed that a crack (C) has occurred on the surface of the processed portion.

In the case of A-5, B-5, C-4 and D-4 in which the alloy composition of the present disclosure is satisfied, but the heat recuperative treatment temperature does not reach the scope of the present disclosure, it can be seen that the high angle grain boundary fraction of the surface layer part is less than 45%, the average grain size of the surface layer part exceeds 3 μm, and the critical bending ratio (r/t) exceeds 1.0. This is because the surface layer part of the steel is excessively cooled during the first cooling, and the reverse transformation austenite in the surface layer part is not sufficiently formed.

In the case of A-6, B-5 and C-5 in which the alloy composition of the present disclosure is satisfied, but the cooling end temperature of the second cooling exceeds the scope of the present disclosure, or in the case of E-3 in which the cooling rate of the second cooling does not reach the scope of the present disclosure, it can be seen that the tensile strength decreases to a level of less than 800 MPa, and the required high strength properties cannot be secured. In addition, in the case of A-1, A-2, A-3, B-1, B-2, B-3, C-1, C-2, D-1, D-2, E-1 and E-2 in which the alloy composition and process conditions of the present disclosure are satisfied as a result of observing the central microstructure of each specimen, bainitic ferrite is formed in the central part, whereas in the case of A-6, B-5, C-5 and E-3 which do not satisfy the second cooling conditions of the present disclosure, it was confirmed that granular ferrite was formed into a matrix structure. For example, it can be seen that in order to secure the required high strength characteristics of the present disclosure, it is effective that the matrix structure of the central part is formed of bainitic ferrite.

In the case of F-1, G-1, H-1 and I-1 not satisfying the alloy composition of the present disclosure, it can be seen that the process conditions of the present disclosure are satisfied, but the tensile strength is a level of less than 800 MPa and the high strength properties required in the present disclosure are not secured.

Therefore, in the case of the examples satisfying the alloy composition and process conditions of the present disclosure, it can be seen that a high strength characteristic of a tensile strength of 800 MPa or more is secured and excellent cold bendability of a critical bending ratio (r/t) of 1.0 or less are secured simultaneously therewith.

Although the present disclosure has been described in detail through examples above, other types of examples are also possible. Therefore, the technical spirit and scope of the claims set forth below are not limited to the embodiments and examples.

The invention claimed is:

1. A structural steel, comprising:

by weight %, 0.02-0.1% of C, 0.01-0.6% of Si, 1.7-2.5% of Mn, 0.005-0.5% of Al, 0.02% or less of P, 0.01% or less of S, 0.0015-0.015% of N, a balance of Fe and other unavoidable impurities, wherein the structural steel is microstructurally divided into an outer surface layer part and an inner central part in a thickness direction, wherein the surface layer part comprises tempered bainite as a matrix structure, the central part comprises bainitic ferrite as a matrix structure, and an average grain size of a microstructure of the surface layer part is 3 μm or less, excluding 0 μm.

2. The structural steel of claim 1, wherein the surface layer part comprises an upper surface layer portion on an upper side of the steel, and a lower surface-layer portion on a lower side of the steel, wherein the upper surface layer portion and the lower surface layer portion each have a thickness of 3 to 10% of a thickness of the steel.

3. The structural steel of claim 1, wherein the surface layer part further comprises fresh martensite as a second structure, and wherein the tempered bainite and the fresh martensite are included in the surface layer part in a fraction of 95 area % or more.

4. The structural steel of claim 3, wherein the surface layer part further comprises austenite as a residual structure, wherein the austenite is included in the surface layer part in a fraction of 5 area % or less.

5. The structural steel of claim 1, wherein the bainitic ferrite is included in the central part in a fraction of 95 area % or more.

6. The structural steel of claim 1, wherein an average grain size of a microstructure of the central part is 5 to 20 μm.

7. The structural steel of claim 1, further comprising, by weight %, one or two or more of Ni: 0.01-2.0%, Cu: 0.01-1.0%, Cr: 0.05-1.0%, Mo: 0.01-1.0%, Ti: 0.005-0.1%, Nb: 0.005-0.1%, V: 0.005-0.3%, B: 0.0005-0.004%, and Ca: 0.006% or less.

8. The structural steel of claim 1, wherein a tensile strength of the steel is 800 MPa or more, and a high angle grain boundary fraction of the surface layer part is 45% or more.

9. The structural steel of claim 1, wherein in a cold bending test, in which a plurality of cold bending jigs having various tip curvature radii (r) are applied to cold-bending the steel by 180° and then whether cracks occur in the surface layer part of the steel occur is observed, and the cold bending jig is applied such that the tip curvature radii (r) are sequentially decreased, a critical curvature ratio (r/t) is 1.0 or less, the critical curvature ratio (r/t) being a ratio of the tip curvature radii (r) of the cold bending jig at a time when the cracks occur in the surface layer part of the steel, with respect to a thickness (t) of the steel.

* * * * *